United States Patent [19]

Biebuyck

[11] Patent Number: 4,644,717

[45] Date of Patent: Feb. 24, 1987

[54] CURTAIN WALL VALVE SYSTEM

[75] Inventor: Lawrence F. Biebuyck, Dallas, Tex.

[73] Assignee: Butler Manufacturing Co., Kansas City, Mo.

[21] Appl. No.: 709,573

[22] Filed: Mar. 8, 1985

[51] Int. Cl.[4] ..... E06B 7/14

[52] U.S. Cl. ..... 52/209; 52/302; 52/403; 52/397

[58] Field of Search ..... 52/209, 408, 302, 397, 52/403, 770, 392, 741

[56] References Cited

U.S. PATENT DOCUMENTS

| | | | |
|---|---|---|---|
| 2,827,674 | 3/1958 | Hauck . | |
| 2,885,040 | 5/1959 | Grossman . | |
| 2,949,981 | 8/1960 | Ferrell | 52/770 |
| 2,960,195 | 11/1960 | Toth . | |
| 2,976,970 | 3/1961 | Toney . | |
| 3,091,008 | 5/1963 | Riegelman | 49/408 |
| 3,199,156 | 8/1965 | Riegelman . | |
| 3,319,388 | 5/1967 | Olsen . | |
| 3,488,906 | 1/1979 | Brooks . | |
| 3,503,169 | 3/1970 | Johnson et al. . | |
| 3,720,025 | 3/1973 | Eichman . | |
| 4,003,171 | 1/1977 | Mitchell | 52/209 |
| 4,055,923 | 11/1977 | Biebuyck . | |
| 4,121,396 | 10/1978 | Oogami et al. . | |
| 4,387,542 | 6/1983 | Wehr | 52/397 |

FOREIGN PATENT DOCUMENTS

| | | | |
|---|---|---|---|
| 906108 | 9/1962 | United Kingdom | 52/209 |

*Primary Examiner*—James L. Ridgill, Jr.

*Attorney, Agent, or Firm*—Thomas L. Cantrell; Stanley R. Moore

[57] ABSTRACT

A curtain wall drainage system for horizontal mullions comprising a flexible, conforming flap member disposed in flush engagement against a weep hole formed in the mullion. The flap permits egress of water infiltrated therein while preventing infusion of water or air turbulence within the mullion from wind loading against the curtain wall. An upper portion of the flap member secured to the outer weep hole surface for permitting pivotal movement therefrom and the passage of water through the weep hole and beneath the flap member. The flap member is constructed of sufficiently resilient and conforming material to permit the presence of a stream of water beneath the flap member from the weep hole to the lower end portion thereof and the creation of a capillary action therein for urging water contained within the mullion downwardly beneath the flap member for discharge from the curtain wall structure. In this manner, mullions may be drained of infiltrated water under conditions not normally faciltating mullion drainage and while preventing air turbulence within the glazing cavity during periods of wind loading.

18 Claims, 1 Drawing Figure

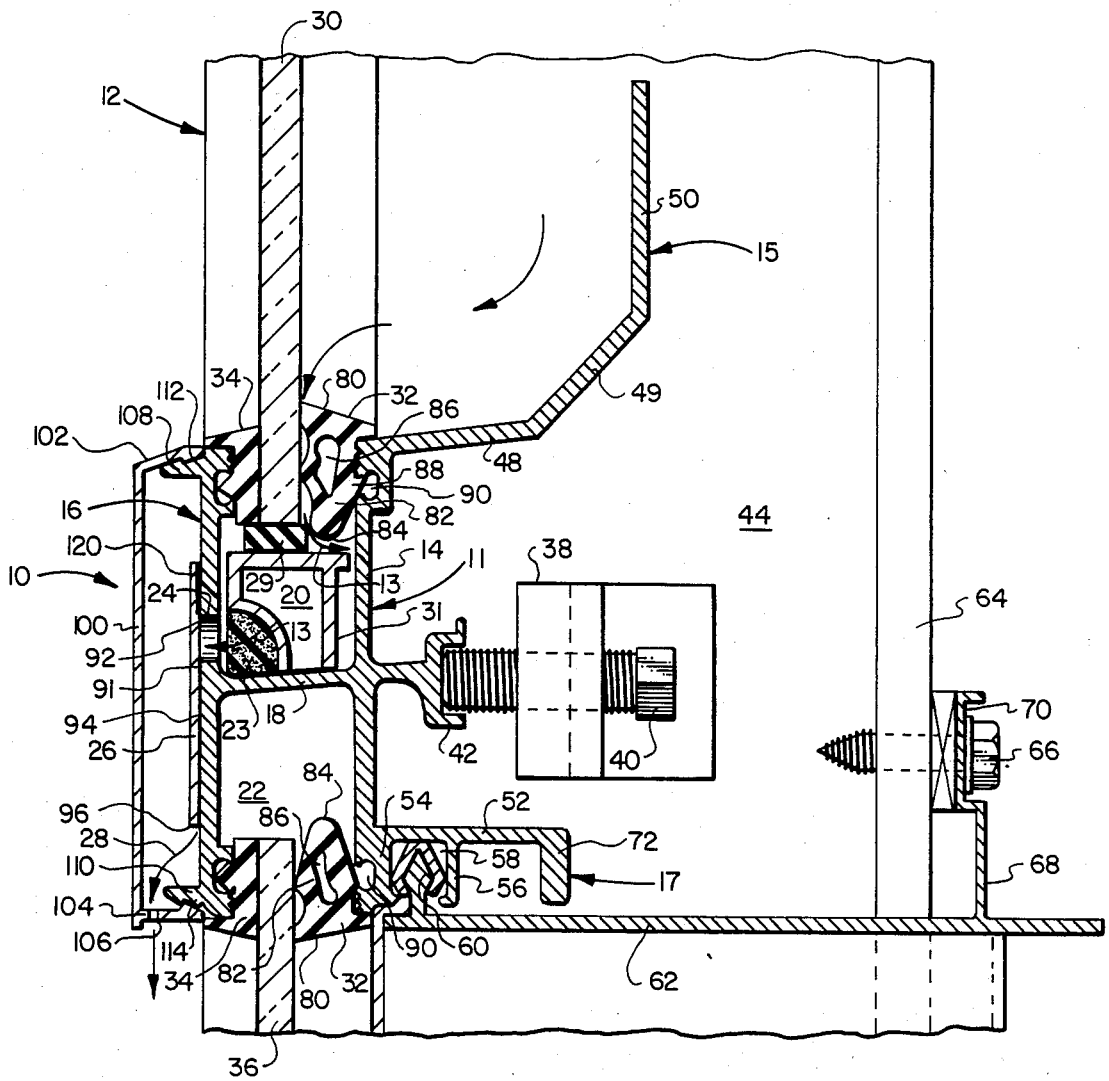
30
12
50
15
49
34
80
32
86
112
108
102
88
48
90
16
82
84
44
120
14
11
38
10
29
20
13
24
31
64
100
13
92
91
70
94
18
23
66
26
42
40
22
84
54
52
96
86
72
28
58
110
17
68
56
104
106
114
90
60
34
82
80
32
62
36

CURTAIN WALL VALVE SYSTEM

BACKGROUND OF THE INVENTION

1. Field of the Invention

The present invention relates to metal wall framing systems, and, more particularly, to a drainage valve system for mullions of a wall framing network.

2. History of the Prior Art

Metal wall framing systems are conventional for fabrication of high-rise commercial structures and the like. In such systems, elongated metal elements—mullions, sills, jams etc.—grip the edges of opaque or transparent panels of various thicknesses to form a coherent wall, either of the store front type or of the curtain wall variety. Typically each mullion comprises an aluminum extrusion providing a variety of cross-sectional configurations, many specially adapted for the particular building fenestration application in water intrusion conditions. Double panel, extruded metal frames, for example, generally incorporate multiple interior chambers and exterior side flange portions. The frame is usually formed of extruded aluminum with a plurality of wind and water seals which afford many advantages over conventional window and door frame constructions These advantages include cost, strength and reduced maintenance. Among the disadvantages of metal, however, is the effectiveness of water intrusion sealing and the provision for elimination of intruded water contained within the hollow mullions.

There are many sources of intruded water in the horizontal and vertical mullions of a curtain wall network. For example, one source is rain water and window washing water which leaks past panel gripping gaskets. Another source of intruded fluid is condensation from moist air within the hollow channel regions of the mullions. Larger quantities of intruded water which is in the portions of the mullions that are exterior of the panels can be disposed of fairly readily by means of open weep holes and the like. However, such weep holes also provide means for moisture infusion back into the mullion. Moreover, water infiltration under high force winds can cause high pressure turbulence within the glazing cavity of the mullion. If sufficient water is permitted to ingress into the hollow mullion regions, along with such turbulence, it will ultimately leak into the interior of the building panels. The water will then be discharged into the interior of the building which is always objectionable and very often causes damage. It is therefore an advantage to effectively discharge all water contained within the mullions prior to any substantial accumulation and to prevent high pressure turbulence therein.

The prior art is replete with various methods and apparatus for the self draining of hollow mullion regions and the like and many of these configurations incorporate the use of flap-valve members. For example U.S. Pat. No. 3,503,169 issued to Johnson et al. on Mar. 31, 1970 describes a self-draining window sill incorporating a valve closure member. The flap-valve element is a substantially flat, rigid member having an upper hinged portion adapted for swinging into a type of abutting contact with an adjacent weep hole or slot formed within the horizontal mullion.

The flap valve approach of the prior art is particularly advantageous because wind pressure against an exposed weep hole can drive water inwardly through the hole and upwardly between the various assembled members of the building fenestration causing both water infiltration and turbulence. The force of the wind against the curtain wall having flap valves will force closure of the valve member to substantially prevent infusion of water. Such valve members are taught in early prior art window sill constructions as set forth in U.S. Pat. No. 2,827,674 issued to Hauck on Mar. 25, 1958 for "Scuppers". This patent illustrates a hinged cover plate adapted for engaging a conventional weep hole to prevent water from being driven therein by wind, rain and the like. Again, a substantially rigid flat plate is incorporated with a hinge mechanism for forming the ventilation aperture. U.S. Pat. No. 3,199,156 issued to Riegelman on Aug. 10, 1965 likewise shows the weep hole construction for windows and the like utilizing a flat member formed of rubber which permits the egress of water through a lower channel region. The cover flap is flexible and pivots along one edge throughout the length of the upstanding flange such that the flap extends generally downward to cover most of the weep hole. Once sufficient fluid accumulates, the pressure will cause the flap to move outwardly about the pivot axis and the groove as shown in that patent reference to allow the fluid to drain.

While the aforesaid prior art embodiments are effective in a myriad of applications, numerous problems still remain relative to high performance demands of water infiltration and drainage with advanced construction designs. Typical structural systems providing a framework adequate to meet the wind loads of conventional curtain walls with silicate seals around the perimeter of each panel are strict and uncompromising. Human error is a constant factor in long term reliability in such constructions. If a seal fails integrity of the wall is compromised and damage to interior trim and furnishings is inevitable. Though the hinged flap approach has been effectively utilized in many instances there is generally no provision made for inducing water collected within a hollow mullion to drain through the weep hole. Moreover, the surface tension of the water often creates a meniscus within the weep hole effectively damming fluid inside the mullion and preventing its escape. Wind and other moisture bearing against the weep hole and panel seals and then infiltrating therethrough can aggravate the already deleterious situation. Such situations can cause existing water accumulations to increase. Even when the water accumulation does not infiltrate the building interior, its very presence within a hollow mullion creates a serious problem. The moisture of the collected water has a tendency to attack the cement used to seal conventional insulated glass in such curtain wall structures. The glass manufacturers are extremely sensitive to designs which permit moisture to lie in the vicinity of a glazing cavity even when said moisture is not in direct contact with the seal of the window. In certain instances, the water vapor and/or condensation can ultimately cause deterioration in the cement and in some situations the glass manufacturer's warranties may even be voided. It is, therefore, of tantamount import that the hollow mullions be constructed in a design not only facilitating egress of water accumulations but effectively urging water deposits to be eliminated.

Pressure differentials between the interior of the building and the outside of the building provide some inducement for fluid flow within the hollow mullions of prior art systems. However, few conventional systems provide the combination of effective sealing mechanisms and means for a pressure differential flow response. This is a distinct need. Without means for inducing water contained within the mullions to flow out, prior art structures are functionally deficient in high moisture, high wind areas such as monsoon regions of the world. Curtain wall constructions are, however, generally accepted construction techniques around the earth. It would be an advantage, therefore, to provide an improved curtain wall sealing and drainage system for conventional, hollow mullion curtain wall constructions.

The method and apparatus of the present invention provides such an improved drainage system for curtain wall structures wherein a weep hole for a hollow mullion is covered by a resilient flap secured thereabove for imparting a substantially flush engagement of the flap against the surface area around and beneath the weep hole. In this manner fluid contained in the mullion and disposed beneath the flap is induced to migrate downwardly through "the capillary force" of the water sealed beneath the resilient flap and against the weep hole and through a "syphoning" action then created. In this manner water contained within the mullion is induced to flow outwardly therefrom for discharging the undesirable fluid content. Unlike prior art configurations, the resilient flap is sealed in a flush conforming configuration against the weep hole and the area therearound in a manner adapted to form a capillary stream in sealed communication with the interior of the mullion. This method of inducing fluid flow is likewise efficient in preventing the infiltration of water and air turbulence from wind bearing thereagainst, yet is responsive to pressure differentials for permitting the discharge of fluids within the mullion due to a lower atmospheric pressure outside the building.

SUMMARY OF THE INVENTION

The present invention relates to a curtain wall drainage valve system of the type wherein a flexible resilient flap member is disposed in flush conforming engagement with the outer surface area of a weep hole formed within a drainage mullion. More particularly, one aspect of the invention comprises an improved drainage system for a curtain wall structure of the type having horizontal mullions secured beneath glass panels disposed within the curtain wall. A weep hole is provided within a lower region of a hollow region of the mullion for permitting egress of water infiltrated therein. The improvement comprises a flexible resilient flap member disposed in flush, conforming engagement against a surface region around the weep hole with an upper portion of the flap member secured to the outer weep hole surface. This configuration permits some degree of flexing movement away from the weep hole and the passage of water therefrom and beneath the flap member. The flap member is constructed of sufficiently resilient material to permit the presence of a confined layer of water beneath the flap member extending from the weep hole to a lower end portion thereof. This creates a capillary action therein for urging water contained within the mullion downwardly beneath the flap member for discharge from the curtain wall structure.

In another aspect, the invention includes the aforesaid drainage system wherein the flap member is comprised of foam silicone rubber. The foam silicone rubber flap member is then bonded to the wall surface above the weep hole with an adhesive. The flap member extends substantially beneath the weep hole to permit the formation of a capillary stream for urging water within the weep hole to discharge downwardly therealong. The flap member and weep hole region of the mullion may also be covered with an outer canopy having a drainage hole formed in the lower region thereof for discharging water egressing from beneath the flap.

In yet another aspect, the invention includes an improved method of draining water from a curtain wall structure of the type having horizontal mullions secured beneath glass panels disposed within the curtain wall. The method includes providing a weep hole within a lower region of a hollow region of the mullion for permitting egress of water infiltrated therein. A flexible flap member is provided in a configuration having sufficient resilience for the formation of a fluid layer therebeneath. The flap is secured to the wall surface area above the weep hole in generally conforming flush engagement against the weep hole and the lower surface area therebeneath. The resilient flap flexes under the presence and pressure of water within the weep hole and forms a capillary path between the weep hole, the adjacent surface beneath the weep hole and the flap. Water is then urged from the weep hole by the capillary action and/or syphoning action urging the water downwardly beneath the flap member. Water is then discharged from the curtain wall structure through the capillary action formed by the flap's flush conforming engagement against the area around the weep hole.

BRIEF DESCRIPTION OF THE DRAWINGS

For a more complete understanding of the present invention and for further objects and advantages thereof, reference may now be had to the following description taken in conjunction with the accompanying drawing in which:

FIG. 1 is a side-elevational, cross-sectional view of one embodiment of a curtain wall drainage system incorporating the principles of the present invention and illustrating the incorporation of a resilient conforming flap outwardly of a drainage hole formed in a horizontal mullion.

DETAILED DESCRIPTION

Referring now to FIG. 1 there is shown a side elevational, cross-sectional view of the improved curtain wall drainage system 10 of the present invention. The drainage system 10 is formed within a horizontal mullion 11 installed within a building 12. The horizontal mullion 11 of this particular embodiment is constructed in a "winged I-beam" configuration with a first inner wall 14 and second outer wall 16 having an intermediate horizontal section 18 defining opposite cavities 20 and 22 therebetween. The "winged" sections comprise upper angulated web section 15 and lower flange 17.

The outer wall 16 of the mullion 11 may be seen to be constructed with a weep hole 24 through which water captured within the hollow region 20 may egress. An open cell foam baffle 23 is disposed adjacent said weep hole to prevent the intrusion of debris or its plugging of the hole 24, while still allowing the water therein to drain. A flat flap member 26 is next shown disposed outside the weep hole 24 in flush, conforming engagement with the outer rim thereof and surface therearound while providing a means for formation of a capillary stream therebeneath. The capillary stream induces the flow of water 13 contained within the hollow section 20 of the mullion 11 to flow downwardly therefrom in the direction of arrow 28 for discharge from the building 12.

The drawing of FIG. 1 further illustrates one embodiment of the assembly of a horizontal mullion of a curtain wall section wherein a glass panel 30 is disposed within an upper end of the mullion 11 and gripped by gasket means therein. The glass 30 rests upon a setting block 29 which is positioned upon a setting chair 31. The setting block 29 may be formed of Neoprene, or the like, while the setting chair 31 may be extruded aluminum. An external gasket 32 and internal wedge 34 engage the lower region of the glass panel 30 for both structural support and the sealing of the panel 30. At the lower end of the mullion 11 gasket 32 and wedge 34 are likewise shown in sealing engagement with an upper end of a panel 36 extending into the lower cavity 22 of said mullion.

The horizontal mullion 11 as shown herein is secured to building 12 by a mounting block 38. The block 38 receives a mounting bolt 40 threadably engaging a mounting channel 42 which extends from an intermediate mullion section 18. The mounting block 38 is also preferably secured to a vertical structural beam 44 by an interlocking and compressive engagement. It should be noted that the above described mounting assembly is presented for purposes of illustration only relative to the mounting of a mullion 11 and any of a myriad of structural configurations may be used in accordance with the present invention.

Still referring to the drawing of the present invention, the horizontal mullion 11 is constructed with the upper and lower webs 15 and 17 set forth above for structural and functional considerations. The upper web 15 comprises a first, generally horizontal, web section 48 connected to an intermediate web section 49 from whence a generally vertical web section 50 upstands. Likewise, the lower flange region 17 comprises a generally horizontal body section 52 from whence a first inside vertical member 54 depends generally parallel with an intermediate vertical section 56. Vertical sections 54 and 56 therein define a channel region 58 adapted for receiving a snap fitting 60. The snap fitting 60 is secured to a generally horizontal plate 62 adapted for securement to an internal wall 64 through a threaded fastener 66. Threaded fastener 66 extends through a generally vertical connection flange 68 having upper recessed head 70 adapted for receiving the bolt member 66 therethrough. The horizontal plate 62 extends inwardly through the interior wall while secured to the flange 17. The interior region of the flange 17 further includes a structural end flange member 72 formed generally orthogonal to body section 52 for purposes of structural rigidity in the assembly. Lower wedge member 32 is shown securing panel 36 immediately adjacent thereto.

The utilization of the resilient wedge 32 to secure the glass panels 30 and 36 against gasket members 34 is conventional in the art. Such web members are usually constructed of resilient material having a generally planar interior wedging surface 80 and tapered body portion 82 terminating in a rounded nose region 84. The body portion 82 generally includes a hollow region 86 for permitting the deformation thereof during the wedge placement within the mullion. A lip 88 is likewise provided for mating engagement within a recess 90 formed within the interior wall 14 of the mullion 11 to secure said wedge therein. As stated above, this particular configuration is set forth herein to illustrate the manufacture and assembly of the present invention with a curtain wall, but is submitted for purpose of illustration only and other configurations may likewise be used in accordance with the teachings of the present invention.

Addressing now the drainage system 10 of the present invention, flap 26 is fabricated from a resilient, conforming and flexible material such as silicone sponge rubber disposed adjacent the weep hole 24 in complete engagement and coverage thereof. One such material is sold under the name COHRlastic, which is the registered trademark of CHR Industries, for flexible, compressible silicone closed cell sponge. It has an extremely low compression set and can maintain its resiliency even under extended compression as from high wind loading. Another variety affords enhanced dimensional stability in the X-Y direction which is a key feature to effective seal and capillary action. Thicknesses on the order of 1/16 inch have been found successful, particularly for the size ratios shown in the drawing. The flap 26 should also exhibit low water absorption characteristics and linear thermal expansion due to the environmental extremes. COHRlastic exhibits water absorption less than 5% and a linear thermal expansion of $1.8\times10^{-4}$ in/in/° F.

The outer mullion wall 16 which receives the flap 26 is preferably planar in the region around the weep hole 24 to permit conformance of the flap 26 thereto. However, the flap 26 is sufficiently conforming to engage non-planar surfaces also. One aspect of the COHRlastic silicone rubber is its thermal stability and its propensity to retain its original dimensions during conformance and after exposure to various chemicals which could be present in window washing solutions. Region 92 immediately surrounding the weep hole 24 is herein shown to be of substantially planar construction and sufficiently smooth to engage the flap member 26 thereupon in a flush, conforming, abutting relationship. Moisture contained within the cavity 20 defined in the upper region of the mullion 11 is then permitted to egress through the weep hole 24. It first engages an underside 94 of the flap member 26. The underside 94 of flap member 26 defines a substantially narrow layer adapted for containing a film of moisture emanating from the weep hole 24. The layer or film 91 of moisture defined between the outer wall of the surface area 92 and the underside 94 of the flap 26 does then create a sealed stream of fluid from the weep hole 24 downwardly to the end 96 of the flap 26. Fluid migrating along the film layer 91 in sealed communication with the weep hole 24 is then induced to flow through capillary action as described below. The flow of fluid in the direction of arrow 28 outwardly from the flap 26 is then permitted to drain away from the mullion 11 and outwardly of the building 12.

Still referring to FIG. 1 the flap member 26 is preferably covered by a generally C-shaped housing or canopy 100 formed with an upper flange section 102 and lower flange section 104. Lower flange 104 includes a drainage hole 106 for permitting water egressing from the flap 26 to be expelled therefrom. The flanges 102 and 104 are constructed for mating engagement with attachment flanges 108 and 110 integrally formed with the outer wall 16 of the mullion 11. Recesses 112 and 114 are formed about said flanges 108 and 110 to permit the expanded or "snapped" placement of canopy ends 102 and 104 thereto. In this configuration, air, rain, dust and other debris are prevented from direct engagement with the flap 26. Such engagement could be deleterious to the flap 26 although it is designed to withstand many substances without deterioration. For example, dust storms, wind, window washing fluids as well as window washing utensils and other objects could damage a resilient and flexible flap 26 if said flap was not protected by the canopy 100. The flap 26 must be sufficiently resilient, conforming, and dimensionally stable to enable a layer of fluid to form and migrate from the weep hole 24 therebeneath. The flap 26 must also maintain its flush conforming engagement with the outer mullion section 16, and thus such a flap could be sensitive to blown debris and/or engagement with window washing equipment.

Relative to assembly of the system 10, the foam baffle 23 is positioned contiguous the weep hole 24 and beneath the setting chair 31 and setting block 29. The flap 26, as shown, is bonded to the outer wall 16 of the mullion 11 through a bonding agent 120 disposed therealong. The bonding agent 120 is preferably of sufficiently strong adhesive to permit a very thin layer to suffice in the bonding of said flap to the mullion 11. In this manner a substantially flush and conforming engagement of the flap member 26 to the outer mullion wall 16 is provided in accordance with the teachings of the present invention. The canopy 100 is then secured thereover in one particular embodiment to further protect the flap 26.

The positioning of fluid 13 within the weep hole 24 and beneath the flap 26 is the result of the physical phenomena of "capillary action". This natural phenomena is due in part to a fluid property known as "surface tension". When two fluids are in contact they exhibit this phenomena due to the molecular attractions which appear to arise from a tension in the surface of separation between said fluids. This phenomena may be expressed in scientific terms as dynes per centimeter or as ergs per square centimeter. In a capillary tube, liquid such as water will thus rise due to surface tension and the interface of the water with the air thereabove. For example, a liquid of density D will rise to a height H in a tube of internal radius R in accordance with the surface tension defined as $T=RHDG/2$ this surface tension is expressed in dynes per centimeter if R and H are expressed in centimeters, D is expressed in grams per cubic centimeter and G is expressed in centimeters per $sec^2$. G is of course the acceleration due to gravity. This capillary force is well defined and experienced in many areas of physics. However, its incorporation into curtain wall drainage systems has not heretofore been recognized or utilized.

It may thus be seen from the discussions above that the fluid within the upper cavity 20 of the mullion 11 is discharged through the weep hole 24 and beneath the flap 26 in a manner preventing its exposure to air in the pattern established therealong. However, in the absence of said fluid path, the liquid present within the cavity 20 will have a tendency to migrate due to capillary action beneath said flap 26 in accordance with these established principals. Once the column of liquid is established beneath the flap 26 it is in sealed communication with the weep hole 24 and the weight thereof drawing upon the weep hole 24 can produce a syphoning action which is an equally recognized phenomena of nature. Only with the flap valve of the present invention fabricated from a resilient, flexible and conforming substance against a wall portion adapted for the formation of a capillary layer in flow communication with a weep hole can a mullion 11 be urged to drain in the manner set forth herein. The prior utilization of flap valves and other drainage systems of the prior art as discussed above can in no way produce the capillary or syphoning action as presented herein in conjunction with withstanding the forces of high pressure air turbulence. Therefore the present invention provides an economically feasible and yet highly effective manner of mullion drainage to prevent the accumulation of fluids within the mullion which may be discharged to the interior of the building. The utilization of the housing 100 further enhances the life of the flap valve, the protection of the drainage system, and permits the utilization of a material of a softer and more resilient consistency unlike prior art embodiments.

It is thus believed that the operation and construction of the present invention will be apparent from the foregoing description. While the method and apparatus shown and described has been characterized as being preferred, it will be obvious that various changes and modifications may be made therein without departing from the spirit and scope of the invention as defined in the following claims.

What is claimed is:

1. An improved drainage system for a curtain wall structure having horizontal mullions defining hollow sections and being secured beneath glass panels disposed within said curtain wall of the type wherein a weep hole is provided within a lower region of said hollow sections of said mullion with a flap disposed thereover for permitting egress of water therefrom and preventing the infiltration of water therein said improvement comprising said flap member being constructed of substantially resilient material disposed in flush engagement against said weep hole, the surface area therearound, and substantially therebeneath, an upper portion of said flap member being secured to said outer weep hole surface for permitting said flush engagement and outward, resilient movement of said flap adjacent said weep hole and said portion thereof extending therebeneath for the passage of water through said weep hole and beneath said downwardly extending flap member, said resilient flap member having material characteristics which permit the presence of a stream of water beneath said resilient flap member and against said surface beneath said weep hole and the creation of capillary action thereunder for urging water contained within said mullion downwardly beneath said resilient flap member extending beneath said weep hole for discharge from said curtain wall structure.

2. The apparatus as set forth in claim 1 wherein the flap member and weep hole region of said mullion are covered with an outer cap member having a weep hole formed in the lower region thereof for discharged water egressing from beneath said flap.

3. The apparatus as set forth in claim 1 wherein said flap member is comprised of closed cell silicone sponge rubber.

4. The apparatus as set forth in claim 3 wherein said silicone rubber flap member is bonded to said wall surface adjacent said weep hole with adhesive.

5. The apparatus as set forth in claim 1 wherein an open cell foam baffle is disposed within said hollow sections of said mullion adjacent said weep hole and said conforming flap disposed outwardly thereof.

6. The apparatus as set forth in claim 5 and further including a setting block disposed atop a setting chair, said setting block and setting chair disposed between an end of said glass panel and said open cell foam baffle, wherein said open cell foam baffle is secured adjacent said weep hole.

7. The apparatus as set forth in claim 1 and further including a cap member adapted for positioning outwardly of said flap member and comprising means for securing said cap member adjacent said flap member and vent means formed within said flap member adapted for permitting the discharge of fluid egressing from beneath said flap member.

8. The apparatus as set forth in claim 7 wherein said cap member is a generally C-shaped canopy having at least one aperture formed in a lower portion thereof.

9. The apparatus as set forth in claim 8 wherein said C-shaped cap member is adapted for engaging said wall portion above and below said flap member.

10. The apparatus as set forth in claim 9 wherein said wall portion around said aperture further includes first and second securement flanges disposed above and below said aperture adapted for matingly engaging upper and lower side portions of said C-shaped cap member for engagement therewith and the covering of said aperture.

11. A method of venting water from a hollow region of a mullion of a curtain wall system comprising the steps of:

forming a hole in the outward side wall of said hollow region of said mullion for the elimination of water therethrough;

forming a flap member of substantially resilient material having material characteristics which permit conformance around a stream of water;

securing said resilient flap member adjacent said aperture;

positioning said aperture along an outer wall section with a surface area therebeneath;

securing an upper portion of said flap member to a wall region above said aperture;

positioning said flap member in generally flush, conforming engagement with said wall area around said aperture and disposing a lower region of said flap member beneath said aperture in flush conforming engagement with said surface area therebeneath;

flowing water flow from said aperture beneath said resilient flap member and conforming said resilient flap member thereover to form a continuous stream said aperture to a lower edge of said flap member;

inducing water within said aperture to flow beneath said resilient, conforming flap member by capillary action; and discharging the water within said hollow region of said mullion by maintaining said conforming flap member over said capillary flow from said aperture between said flap member and said surface area beneath said aperture and a flow communication with water within said mullion.

12. The method as set forth in claim 11 wherein step of providing a resilient flap member comprises the step of forming a generally planar conforming flap from silicone closed cell sponge rubber wherein said flap length is substantially greater than said flap thickness thereby permitting sufficient resiliency for the formation of a capillary stream therebeneath.

13. The method as set forth in claim 11 wherein said step of securing said flap member above said aperture comprises the steps of providing an adhesive adapted for bonding to said wall and bonding said flap member thereto substantially across the upper region of said aperture.

14. The method as set forth in claim 13 wherein said step of bonding said flap member to said wall area above said aperture includes the step of providing an outer canopy adapted for substantially encompassing said flap member and securing said canopy over said flap member, said canopy having an aperture formed in the lower wall thereof adapted for permitting water egressing from beneath said flap member to egress outwardly of said canopy.

15. The method as set forth in claim 11 wherein said step of forming said hole in the outward sidewall comprises the steps of locating a lower portion of said mullion adjacent a lower region of said water collection trough therein having a generally planar surface area for capillary action therebeneath, and drilling an aperture through said outer wall region for flow communication with said interior region of said mullion and said capillary flow therefrom.

16. The method as set forth in claim 15 and further including the step of countersinking outer edges of said aperture in said outer wall of said mullion for providing a tapered surface area and facilitating fluid flow into said capillary stream beneath said flap member from said hollow region of said mullion.

17. The method as set forth in claim 11 and further including the steps of providing an open cell foam baffle, positioning said baffle within said hollow region of said mullion contiguous said aperture along said outer wall section, and securing said open cell foam baffle thereagainst.

18. The method as set forth in claim 17 wherein said step of securing said open cell foam baffle against said aperture includes the steps of providing a setting chair, and positioning said setting chair within said hollow region of said mullion against said open cell foam baffle for securing said open cell foam baffle between said setting chair and said outer wall section.

* * * * *